US006942258B2

(12) United States Patent
Roos

(10) Patent No.: US 6,942,258 B2
(45) Date of Patent: Sep. 13, 2005

(54) OPERATING ARRANGEMENT FOR A SLIDING DOOR

(75) Inventor: Martin Roos, Östrich-Winkel (DE)

(73) Assignee: Mannesmann VDO AG, Frankfurt (DE)

( * ) Notice: Subject to any disclaimer, the term of this patent is extended or adjusted under 35 U.S.C. 154(b) by 0 days.

(21) Appl. No.: 09/755,978

(22) Filed: Jan. 5, 2001

(65) Prior Publication Data

US 2001/0030430 A1 Oct. 18, 2001

(30) Foreign Application Priority Data

Jan. 11, 2000 (DE) ..... 100 00 639

(51) Int. Cl.[7] ..... E05C 3/26
(52) U.S. Cl. ..... 292/201; 292/216
(58) Field of Search ..... 292/216, 201; 74/501.5, 502.4, 502.6

(56) References Cited

U.S. PATENT DOCUMENTS

| | | | | | |
|---|---|---|---|---|---|
| 3,857,594 | A | * | 12/1974 | Pastva, Jr. | 292/27 |
| 4,524,632 | A | * | 6/1985 | Ballard | 192/48.9 |
| 4,615,558 | A | * | 10/1986 | Nakamura et al. | 296/203.03 |
| 4,617,757 | A | * | 10/1986 | Kagiyama et al. | 49/280 |
| 4,756,563 | A | * | 7/1988 | Garwood et al. | 292/216 |
| 4,763,936 | A | * | 8/1988 | Rogakos et al. | 292/201 |
| 4,775,178 | A | * | 10/1988 | Boyko | 292/341.16 |
| 5,131,288 | A | * | 7/1992 | Barlas | 188/2 D |
| 5,338,076 | A | * | 8/1994 | Tanaka | 292/336.3 |
| 5,618,068 | A | * | 4/1997 | Mitsui et al. | 292/201 |
| 5,697,236 | A | * | 12/1997 | Kleefeldt et al. | 292/201 |
| 5,718,465 | A | | 2/1998 | Dowling et al. | |
| 5,749,611 | A | | 5/1998 | Watson et al. | |
| 5,829,314 | A | * | 11/1998 | Scura | 188/24.11 |
| 5,857,386 | A | * | 1/1999 | Ruhlman | 292/171 |
| 5,893,593 | A | | 4/1999 | Dowling | |
| 5,934,817 | A | | 8/1999 | Kim et al. | |
| 6,017,067 | A | * | 1/2000 | Yoneyama et al. | 292/216 |
| 6,032,987 | A | * | 3/2000 | Fukumoto et al. | 292/201 |
| 6,050,117 | A | * | 4/2000 | Weyerstall | 292/201 |
| 6,116,664 | A | * | 9/2000 | Wegner | 292/201 |
| 6,126,211 | A | * | 10/2000 | Dominquez | 292/174 |
| 6,256,932 | B1 | * | 7/2001 | Jyawook et al. | 49/503 |
| 6,276,743 | B1 | * | 8/2001 | Jyawook et al. | 296/155 |
| 6,305,238 | B1 | * | 10/2001 | Gabas | 403/13 |
| 6,398,271 | B1 | * | 6/2002 | Tomaszewski et al. | 292/216 |

FOREIGN PATENT DOCUMENTS

| | | | | |
|---|---|---|---|---|
| DE | 3934982 A1 | * | 5/1990 | E05B/65/12 |
| GB | 2240583 A | * | 8/1991 | E05B/15/00 |
| GB | 2295642 | | 6/1996 | |

* cited by examiner

*Primary Examiner*—Jack W. Lavinder
(74) *Attorney, Agent, or Firm*—Martin A. Farber

(57) ABSTRACT

A system for operating a door lock (14) and a latching device (16), which can be arrested in a positive-locking manner, of a sliding door (10), said latching device preventing the sliding door (10) in its open position from sliding back. The operation of the door lock (14) and latching device (16) takes place mechanically via connecting elements, and the logical closing functions, are integrated in the door lock (14) which is situated remote from the door handles. In order to avoid very long connecting elements with cumulative tolerances, the connecting elements (22, 24) between the door handles and the door lock (14) have driver elements (40, 42) which act via a driven element (32, 44) on a connecting element (28) connected to the latching device (16).

11 Claims, 3 Drawing Sheets

OPERATING ARRANGEMENT FOR A SLIDING DOOR

FIELD AND BACKGROUND OF THE INVENTION

The invention is concerned with an operating arrangement for a sliding door, in particular of motor vehicles, having a door lock, a latching device which can be arrested in a positive-locking manner and is intended for holding the sliding door in its open position, and an inside door operating means having an inside door handle and also an outside door operating means having an outside door handle, it being possible for the door lock and the latching device to be operated mechanically by the door handles via connecting elements, and the logical functions for locking/unlocking the sliding door are realized in the door lock.

In order to prevent open sliding doors from sliding back, it is generally customary to arrest the sliding door in a nonpositive- or positive-locking manner. This latching device is preferably intended to be operated via the door handles independently of one another.

In known operating arrangements, the outside operating means and the inside operating means do not act directly on the latching device, which can be arrested in a positive-locking manner; instead, a control mechanism is connected inbetween which also realizes the logical functions for operating the door lock, such as the central locking system, central securing system or child safety catch, for example. This control mechanism is fitted in the region of the door handles, the latching arrangement frequently also being arranged in the vicinity of the door handles on the lower, front fastening arm of the sliding door.

However, relatively new developments of door locks tend toward integrating the control mechanism in the door lock which, in the case of sliding doors, is fitted in the rear region on the end of the door which lies opposite the door handles.

An operating arrangement according to the principle to date would consequently require connecting elements running, on the one hand, from the door handles to the door lock and, on the other hand, from the door lock to the latching device, it being possible for the long distances and cumulative tolerances to cause problems during opening of the latching device or else at least resulting in an unfavorable operating performance with an undefined release point.

SUMMARY OF THE INVENTION

The object of the present invention is to provide an operating arrangement for sliding doors, which arrangement makes it possible for the latching device to be operated with the aid of the door handles with lower tolerances.

According to the invention, the object is achieved by an operating arrangement of the type described at the beginning, in which the connecting elements between the two door handles and the door lock have driver elements which act via a driven element on a connecting element connected to the latching device.

The advantage of the driving elements arranged as near as possible to the door handles is that the effective length of connecting elements between the door handles and the latching device is considerably reduced resulting, in conjunction with the small number of cumulative tolerances, in a reliable operation of the latching device with a defined release point. The relatively short connecting elements of the latching device also simplify the installation of the sliding door with less material being used and a reduced weight.

Preferably, at least for the two door handles, separate connecting elements and driver elements are provided, the latter interacting with a single driven element. An operating arrangement of this type manages with a small number of parts, the driver elements preferably lying directly next to one another and the connecting elements running parallel to one another at least in this region. Additional driver elements may, for example, be provided when the operation of the latching device is not only to be possible with the aid of the door handles, but also with the aid of a servo-motor.

In a preferred embodiment of the invention, the driver elements act on a reversing lever on which the connecting element to the latching device is secured. A reversing lever, whose pivot point may, for example, lie between the engagement points of the connecting elements between the door handles and the door lock and the connecting element to the latching device, provides the possibility, in a confined space, of reversing the direction of movement so as to enable an advantageous arrangement of the connecting elements and, if appropriate, also to ensure a transmission ratio.

In a particularly preferred embodiment of the invention, the driver elements are uncoupled from the connecting element to the latching device in such a manner that driving only takes place in a relative direction of movement to one another. The effect achieved by this measure is that when the door handles are operated so as to open the door lock, the door handles are not subjected to an additional load because of the latching device, which is basically unlocked in this case, with the result that the operating forces are not higher than in the case of door handles which cannot act on the latching device.

A particularly expedient and simple uncoupling makes provision for the uncoupled driving to take place by simple bearing of the driver element against a driving surface on the reversing lever. It is also conceivable for the connecting element to the latching device to correspondingly interact with the reversing lever.

It is particularly advantageous to design the connecting elements at least partially as Bowden cables, since primarily a transmission of tensile forces is necessary, and Bowden cables can be fitted in a relatively simple manner, particularly in very wide sliding doors. Bowden cables furthermore make it possible, at least to a certain extent, to adapt the profile of the connecting elements to the structural conditions of the sliding door.

In a further preferred design of the invention, provision is made for the Bowden cables of the connecting elements from the door handles to be of continuous design in the region of the driving elements, the sheath having been omitted in this region. The continuous design avoids the unnecessary accumulation of tolerances which could make the operation of the door lock more difficult. Since the operating performance of Bowden cables also depends substantially on their Bowden-cable sheaths which absorb the reaction forces, it is furthermore of particular advantage to allow the Bowden-cable sheaths of the door-handle connecting elements to end molded onto the walls of a housing body on which the reversing lever is pivotably mounted. The Bowden cable between the respective door handle and the door lock therefore does not behave any differently than a Bowden cable designed with a continuous Bowden-cable sheath, with the result that the operating performance in the case of the operating arrangement according to the invention is not worse than in continuous solutions. A mirror-symmetrical design of the housing body permits the use thereof in sliding doors on both sides of the vehicle.

BRIEF DESCRIPTION OF THE DRAWINGS

An exemplary embodiment of the invention is explored in greater detail below with reference to the attached drawings, in which.

DETAILED DESCRIPTION OF THE PREFERRED EMBODIMENT

Figure 1:
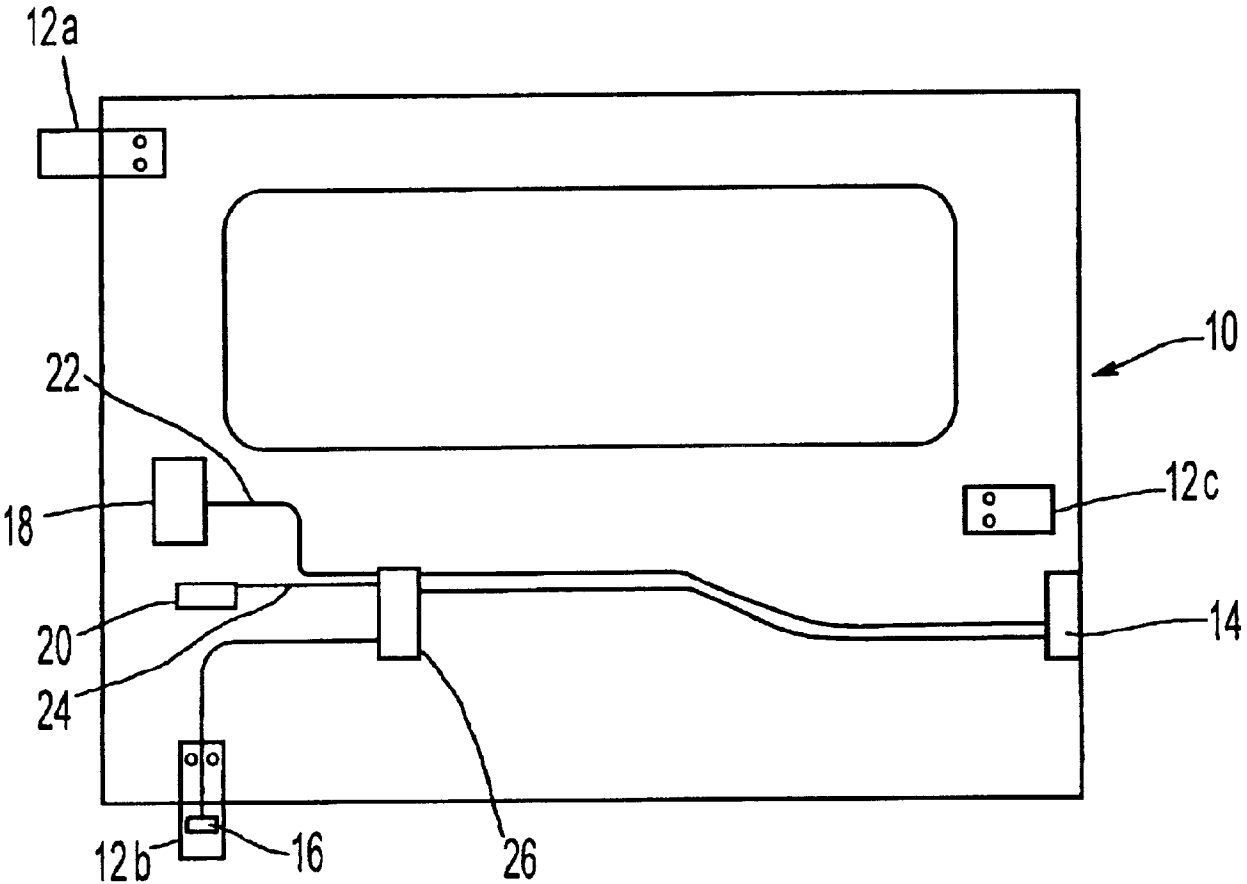
FIG. 1 shows a schematic illustration of the components of an operating arrangement for a sliding door.

FIG. 1 shows a schematic sketch of the design of an operating arrangement of a sliding door 10 as used in motor vehicles. The sliding door 10 has three guide elements 12*a, b, c* which interact with guide rails on the vehicle and are arranged in the front, upper region, on the lower edge in the front region and on the rear side of the sliding door 10 in the central region. A door lock 14 having a lock latch is likewise arranged in the rear region of the sliding door 10 and locks the sliding door when it is closed by interacting with a closing bracket arranged on the vehicle. In the region of the lower guide element 12*b* there is furthermore provided a latching device 16 which can be arrested in a positive-locking manner and which can be used to latch in the sliding door 10 in a positive-locking manner when open so as to avoid it unintentionally sliding back into the closed position.

The operating arrangement furthermore has an inside door operating means 18, which can be released via an inside door handle (not illustrated) accessible from the vehicle interior, and an outside door operating means 20 having an outside door handle (not shown) which is accessible from the outside. The inside operating means 18 is connected to the door lock 14 via a first Bowden cable 22 as the connecting element, while the outside operating means 20 is coupled to the door lock 14 via a second Bowden cable 24.

The logical closing functions are integrated in the door lock 14 which produces the connection of the Bowden cables 22 and 24 to the detent pawl or frees or blocks them depending on the selected setting, such as central locking system, central securing system or child safety catch, for example.

In a region in which the two Bowden cables 22, 24 run parallel directly next to each other, a reversing device 26 is provided which is connected via a third Bowden cable 28 to the latching device 16, the reversing device 26 enabling the latching device 16 to be released by the Bowden cables 22, 24 being moved by means of the door handles.

Figure 2:
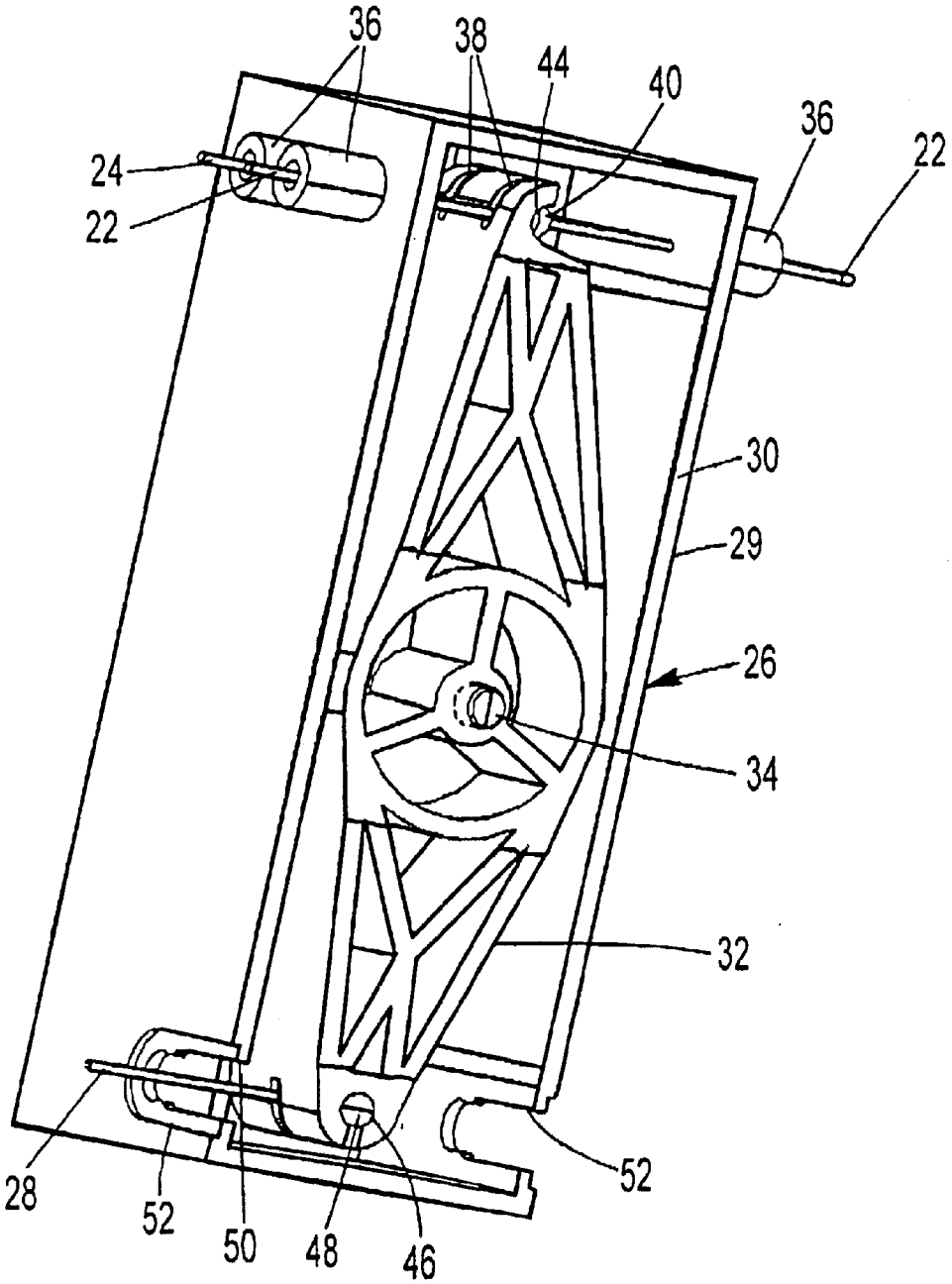
FIG. 2 shows an oblique view of the deflecting device from FIG. 1.

In FIG. 2, the reversing device 26 is illustrated in an oblique view with the housing 29 open. The housing 29 consists of a housing body 30 manufactured from plastic and of a housing cover (not illustrated). A reversing lever 32 is rotably mounted about a pivot spindle 34 in the housing 30. Like the housing 29, the reversing lever 32 is manufactured from plastic.

Figure 5:
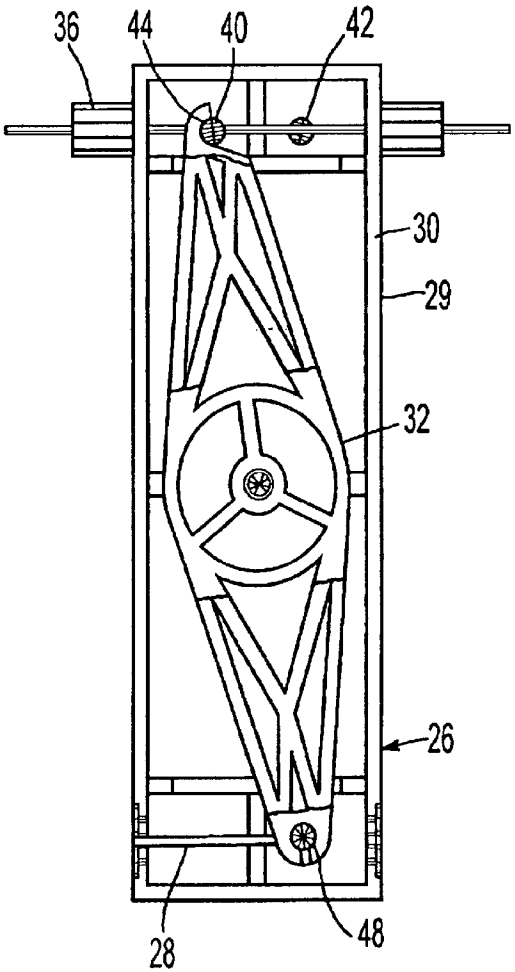
FIG. 5 shows a view corresponding to FIG. 4 with the inside door handle operated.
Figure 4:
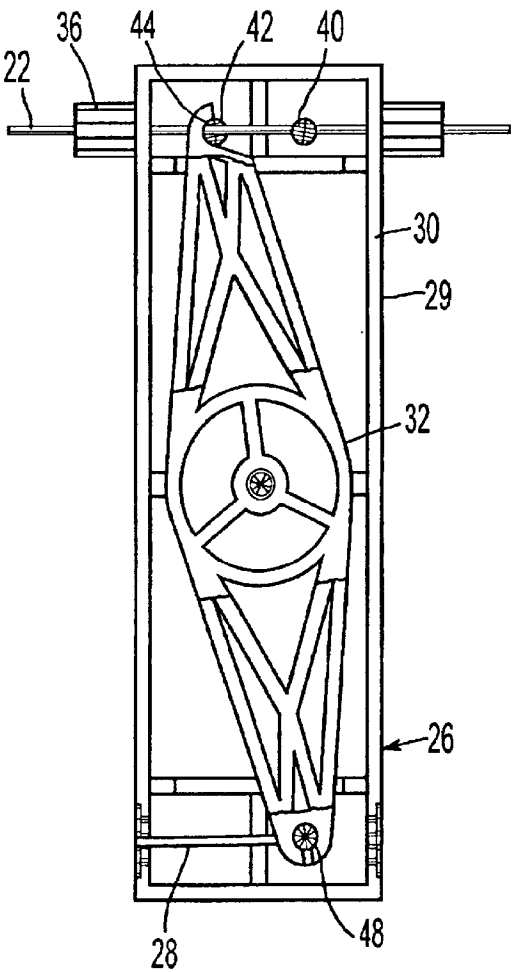
FIG. 4 shows a view of the deflecting device according to FIG. 3 with the latching device open and the outside door handle operated.

The first Bowden cable 22 of the inside operating means 18 and the second Bowden cable 24 of the outside operating means are guided in the upper region through the housing body 30, the Bowden-cable sheaths 36 being directly molded onto the housing body 30, with the result that the Bowden cables 22, 24 perform as continuous Bowden cables without an increase in tolerances occurring on account of the reversing device 26 connected inbetween. In the interior of the housing, the two Bowden cables 22, 24 run without sheaths through cutouts 38 on one end of the reversing lever 32, there being secured, in a nonpositive- or positive-locking manner, a first driver element 40 on the wire core of the first Bowden cable 22 and a second driver element 42 on the wire core of the second Bowden cable 24 (see FIGS. 4 and 5). The driver elements (40, 42) have a rounded outer contour matching the contour of a bearing surface 44 (see FIGS. 3 to 5) on the reversing lever 32. The driver elements bear freely against the bearing surface 44, with the result that the reversing lever is uncoupled from the driver elements 40, 42 in such a manner that though driving by the driver elements 40, 42 is possible for unlocking the latching device 16, the reversing lever 32 remains in its unlocking position after the unlocking, while the driver elements 40, 42 return into their starting position after the respectively operated door handle has been released. This is explored in more precise detail later on in conjunction with FIGS. 4 and 5.

At its end lying opposite the bearing surface 44, the reversing lever 32 is provided with a socket 46 in which a driver element 48 of the third Bowden cable 28 to the latching device 16 is fitted. The third Bowden cable 28 runs through an opening 50 in the housing body 30 in whose end region the Bowden-cable sheath 52 (see FIG. 2) of the third Bowden cable 28 is fastened. Furthermore, the housing body 30 has an additional opening 54 in its wall which is opposite the opening 50 and permits a mirror-inverted fitting of the housing 28.

Figure 3:
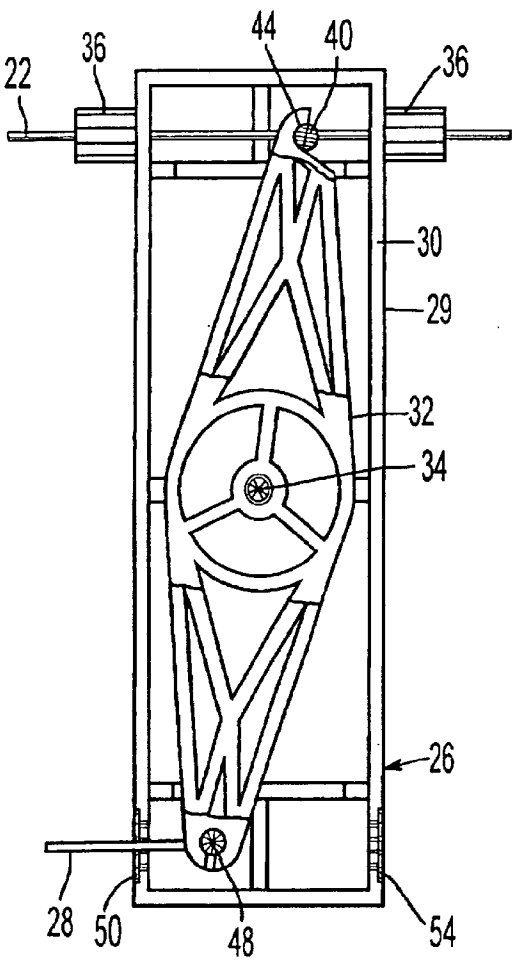
FIG. 3 shows a view of the deflecting device according to FIG. 2 with the latching device closed.

FIG. 3 shows a position of the reversing device 26 in which the latching device 16 is latched in a positive-locking manner, i.e. the sliding door 10 is open and neither the inside door operating means 18 nor the outside door operating means 20 have been released. If it is now desired to close the sliding door 10, the first driver 40 can be shifted by operating the inside door handle, in accordance with the illustration of FIG. 5, or the second driver 42 can be shifted by operation of the outside door handle, in accordance with the illustration in FIG. 4, the respective driver element 40, 42 pivoting the reversing lever 32 via the bearing surface 44. After the latching device 16 has been released and the sliding door 10 unblocked, the reversing lever 32 remains in the open position illustrated in FIGS. 4 and 5, while the respectively operated driver element 40 or 42 returns, after the door handle has been released, to the inoperative position illustrated in FIG. 3. Even after the door lock 14 of the sliding door has been latched into place, the reversing lever 32 remains in its open position, with the result that when the door lock 14 is operated by the inside door operating means 18 or the outside door operating means 20, no additional forces act on the two Bowden cables 22, 24. Consequently, in comparison with an operating arrangement without a reversing device 26, higher manipulating forces are not necessary when unlocking the sliding door 10.

The design of the housing body 30 virtually as a constituent part of the Bowden-cable sheaths 36 of the first and second Bowden cables 22, 24 avoids an accumulation of tolerances, so that reliable operation of the door lock 14 with a precise release point is possible. However, the housing body 30 has to be of sufficiently stiff design between the inlet and outlet points of the Bowden cables 22, 24.

While the reversing device 26 effects a reversal of the direction of movement, which is advantageous in the majority of installation positions, and also enables a transmission ratio by variation of the lever-arm lengths, it is basically also conceivable for the driver element 48 to be directly driven, for example in a sliding guide, by the driver element 40 of the first Bowden cable or by the driver element 42 of the second Bowden cable.

Departing from the illustrated implementation of the uncoupling by the driver elements 40, 42 bearing loosely against the bearing surface 44, uncoupling may also be achieved by the driver element 48 of the third Bowden cable 28 interacting in a similar manner with a bearing surface and by the two driver elements 40, 42 of the first and second Bowden cables 22, 24 being fitted in the reversing lever 32. Even a play eliminator, effective in the pushing direction, in the third Bowden cable 28 is conceivable for realizing the uncoupling, but is more complicated.

Departures from the embodiment described are particularly also conceivable in the arrangement of the latching device 16 which can basically be arranged on one of the illustrated guide elements 12*a, b, c* whose position may deviate from the illustrated exemplary embodiment. Even an arrangement of the latching device separate from the guide elements is conceivable.

I claim:

1. An operating arrangement for a sliding door (10), comprising: a door lock (14) for locking the door (10) in a closed position of the door, a latching device (16) which is distant from the door lock and can be arrested in a positive-locking manner and serves for holding the sliding door (10) in its open position, an inside door operating means (18) having an inside door handle, an outside door operating means (20) having an outside door handle, a driven element (32, 44), and a plurality of connecting elements (22, 24, 28) including a first connecting element (22) extending from the inside door operating means (18) to the door lock (14), a second connecting element (24) extending from the outside door operating means (20) to the door lock (14), and a third connecting element (28) extending from the latching device to the driven element, the driven element (32, 44) being drivable by either one of the inside door handle and the outside door handle via respectively the first connecting element (22) or the second connecting element (24) to act on the latching device (16) via the third connecting element, wherein the door lock (14) and the latching device (16) are able to be operated mechanically by the door handles via said plurality of connecting elements (22, 24, 28), and logical functions for locking/unlocking the sliding door (10) are realized in the door lock (14), and wherein the first and the second connecting elements (22, 24) are provided respectively with driver elements (40, 42) for engaging the driven element, the driver elements being located between the two door handles and the door lock (14) at a distance from the door lock (14), to effect the drivability of the driven element (32, 44) by either one of the door handles, and wherein the first connecting element is uncoupled from the second connecting element enabling the first and the second connecting elements to move independently of each other.

2. The operating arrangement as claimed in claim 1, wherein at least for said two door handles, separate ones of said connecting elements (22, 24) and said driver elements (40, 42) are provided, the latter interacting with said driven element (32, 44).

3. The operating arrangement as claimed in claim 2, wherein the driver elements (40, 42) lie directly next to one another and said connecting elements (22, 24) from the door handles run parallel to one another at least in this region.

4. The operating arrangement as claimed in claim 1, wherein the driver elements (40, 42) act on a reversing lever (32) on which the third connecting element (28) to the latching device (16) is secured.

5. The operating arrangement as claimed in claim 1, wherein the driver elements (40, 42) are uncoupled from the third connecting element (28) to the latching device (16) such that driving only takes place in one direction of movement of the driver elements relative to the connecting element (28).

6. The operating arrangement as claimed in claim 5, wherein uncoupled driving takes place by simple bearing of said driver elements (40, 42) against a driving surface (44) on reversing lever (32).

7. The operating arrangement as claimed in claim 1, wherein the connecting elements (22, 24, 28) are at least partially formed as Bowden cables.

8. The operating arrangement as claimed in claim 7, wherein said Bowden cables (22, 24) of the connecting elements from the door handles are continuous in a region of the driver elements (40, 42), and Bowden-cable sheaths (36) being omitted in said region.

9. An operating arrangement for a sliding door (10), comprising: a door lock (14) for locking the door (10) in a closed position of the door, a latching device (16) which is distant from the door lock and can be arrested in a positive-locking manner and serves for holding the sliding door (10) in its open position, an inside door operating means (18) having an inside door handle, an outside door operating means (20) having an outside door handle, a driven element (32, 44), and a plurality of connecting elements (22, 24, 28) including a first connecting element (22) extending from the inside door operating means (18) to the door lock (14), a second connecting element (24) extending from the outside door operating means (20) to the door lock (14), and a third connecting element (28) extending from the latching device to the driven element, the driven element (33, 44) being drivable by either one of the inside door handle and the outside door handle via respectively the first connecting element (22) or the second connecting element (24) to act on the latching device (16) via the third, connecting element, wherein the door lock (14) and the latching device (16) are able to be operated mechanically by the door handles via said plurality of connecting elements (22, 24, 28), and logical functions for locking/unlocking the sliding door (10) are realized in the door lock (14), and wherein the first and the second connecting elements (22, 24) are provided respectively with drive elements (40, 42) for engaging the driven element, the driver elements being located between the two door handles and the door lock (14), at a distance from the door lock (14) to effect the drivability of the driven element (32, 44) by either one of the door handles;

wherein individual ones of the plurality of connecting elements (22, 24, 28) are at least partially formed as Bowden cables, and said Bowden cables (22, 24) of the first and the second connecting elements from the door handles are continuous in a region of the driver elements (40, 42), Bowden-cable sheaths (36) being omitted in said region, the driven element comprising a reversing lever (32) pivotably mounted within a housing body (30); and Bowden-cable sheaths (36) of the first and the second connecting elements (22, 24) are end molded onto walls of the housing body (30) on which the reversing lever (32) is pivotably mounted.

10. The operating arrangement as claimed in claim 9, wherein said housing body (30) is of substantially mirror-symmetrical formation.

11. A system for operating a sliding door in a vehicle, the system comprising:

a door lock for securing the door in its closed position, a latching device which is distant from the door lock and can be arrested in a positive-locking manner to hold the sliding door in its open position, an inside door operating means having an inside door handle, an outside door operating means having an outside door handle, a driven element, a plurality of connecting elements including a first connecting element extending from the inside door operating means to the door lock, a second connecting element extending from the outside door operating means to the door lock, and a third connecting element extending from the latching device to the driven element, the driven element having opposed first and second ends;

wherein the door lock and the latching device are operated mechanically by the inside and the outside door handles via respectively the first and the second of said connecting elements; logical functions for locking/unlocking the sliding door are realized in the door lock; the first and the second connecting elements engage with the first end of the driven element and act via a pivoting of the driven element and via the third connecting element to drive the latching device, the latching device being coupled via the third one of said connecting elements to the second end of said driven element, and wherein the first and the second connecting elements are provided with driver elements located between the inside door handle and the outside door handle and the door lock at a distance from the door lock to effect the drivability of the driven element by either one of the door handles.

* * * * *